US005127590A

United States Patent [19]

Bunton

[11] Patent Number: 5,127,590

[45] Date of Patent: Jul. 7, 1992

[54] ROTATING THROAT/AIR PORT RING ASSEMBLY

[75] Inventor: Joe H. Bunton, Fort Collins, Colo.

[73] Assignee: March-Sourthwestern Corp., Fort Collins, Colo.

[21] Appl. No.: 682,647

[22] Filed: Apr. 9, 1991

[51] Int. Cl.[5] ..... B02C 19/00

[52] U.S. Cl. ..... 241/119; 241/121

[58] Field of Search ..... 241/119, 60, 61, 121

[56] References Cited

U.S. PATENT DOCUMENTS

| | | | |
|---|---|---|---|
| 4,084,754 | 4/1978 | Brundiek | 241/119 X |
| 4,234,132 | 11/1980 | Maliszewski | 241/119 X |
| 4,264,041 | 4/1981 | Kitto, Jr. et al. | 241/119 X |
| 4,504,020 | 3/1985 | Nishida et al. | 241/121 |
| 4,523,721 | 6/1985 | Maliszewski et al. | 241/119 X |
| 4,687,145 | 8/1987 | Dougan et al. | 241/119 X |
| 4,715,544 | 12/1987 | Folsberg | 241/119 X |
| 4,721,258 | 1/1988 | Dougan et al. | 241/119 X |
| 4,752,037 | 6/1988 | Farris et al. | 241/119 X |
| 4,907,751 | 3/1990 | Wark et al. | 241/119 |
| 5,020,734 | 6/1991 | Novotny et al. | 241/119 |

*Primary Examiner*—Mark Rosnebaum
*Assistant Examiner*—Frances Chin
*Attorney, Agent, or Firm*—Dean P. Edmunsson

[57] ABSTRACT

An improved rotating throat/air port ring assembly is described for use in a pulverizing mill of the type including a rotating bowl member in a housing. The improved assembly includes (1) a vaned throat/air port ring element secured to the periphery of the bowl and including vanes which are tilted 20° to 40° from vertical, (2) an inclined liner extending around the bowl above the ring element, and (3) a skirt extending outwardly and downwardly from the ring element to guide inlet air through the vaned throat/air port ring element.

14 Claims, 4 Drawing Sheets

ROTATING THROAT/AIR PORT RING ASSEMBLY

FIELD OF THE INVENTION

This invention relates to pulverizing apparatus. More particularly, this invention relates to pulverizer mills of the type used for grinding or crushing coal in the preparation of finely divided coal as a fuel source in power generating plants, for example. Even more particularly, this invention relates to improvements in stationary throat/air port ring assemblies for use in pulverizing mills.

BACKGROUND OF THE INVENTION

Pulverizing apparatus of various types has been used for decades to reduce the particle size of a variety of solid materials (e.g., coal). Pulverizing mills are commonly used in power generating plants to crush and grind coal to produce coal dust used as fuel in the generation of electrical power. Pulverizing mills of this type are described, for example, in U.S. Pat. Nos. 4,523,721, 4,264,041, and 4,687,145.

The pulverizing mills described in such patents include a housing, a rotating bowl member for crushing solid materials such as coal present in the bowl, and an annular passage between the interior surface of the housing and the periphery of the bowl member which enables air to flow upwardly through the passage. As the coal is crushed and made into small particles (i.e., dust), the air flowing upwardly through the passage at the periphery of the bowl is intended to lift and carry the dust particles out of the housing and into a fuel stream for the power plant.

The conventional throat/air port designs used in prior pulverizing mills require expensive and difficult installation techniques using wear-resistant materials. The vanes which are present in the throat are typically tilted at least about 45° from vertical and are oriented in the direction of rotation of the rotating bowl member.

Prior designs are complicated. For adequate service life, all typically require the use of wear-resistant material which is quite heavy. Some designs utilize a series of stationary throats or vanes and some utilize rotatable throats.

All conventional throat/air port designs are intended to swirl the upwardly moving air or cause it to spin as it passes through the throat area. This requires rapidly moving air. Such swirling air, however, creates an unnecessary turbulence inside the mill body. This turbulence or swirling air flow will cause local high rates of wear on all internal mill parts. This is due to the nature of the prior designs and their continual contact with pulverized coal particles.

SUMMARY OF THE PRESENT INVENTION

In accordance with the present invention there is provided an improvement for a pulverizer mill of the type including a housing, a rotating bowl member rotatably supported in the housing, a grinding member for crushing solid materials (e.g., coal) present in the bowl, and an annular passage between the interior surface of the housing and the periphery of the bowl member which enables air to flow upwardly through the passage to carry small particles of the solid material upwardly and out of the mill. The improvement comprises:

(a) a vaned throat/air port ring element secured to the periphery of the bowl member and extending into the annular passage, the ring element including a plurality of spaced-apart vane members having upper and lower ends; wherein the vane members are oriented at an angle in the range of 20° to 40° relative to a vertical axis in a manner such that the upper ends are tilted away from the direction of rotation of the bowl member;

(b) an inclined liner member extending around the bowl member above the ring element, wherein the liner member includes inner and outer edges; wherein the outer edge is adjacent the interior surface of the housing and the inner edge is above the outer periphery of the ring element and further includes a vertical wall section extending downwardly to a point adjacent the ring element; and (c) a skirt element surrounding the ring element; wherein the skirt member extends outwardly and downwardly from the ring element to a point adjacent the interior surface of the housing; wherein the angle of the skirt member relative to a vertical axis is in the range of 40° to 60°.

The improvement provided by the present invention exhibits significant advantages over conventional pulverizer mill designs. Most importantly, the apparatus of the present invention provides for air flow upwardly through the vaned throat/air port ring element in a manner such that the air flow is essentially vertical (as opposed to a spinning or swirling movement obtained with conventional apparatus). Thus, with the apparatus of this invention, the air flow allows for maximum possible upward transport of pulverized material (e.g., coal dust) with minimum required air velocity.

Because the apparatus of this invention utilizes the maximum amount of energy available, the required velocity of the air used with the apparatus of the present invention is less than that required for use with conventional apparatus. Because the velocity of the air is very low, the pressure drop across the rotating throat/air port ring assembly is low and the upward momentum of the crushed particles is also low. As a result, this affords a primary classification effect of the larger particles.

Also, a reduced pressure drop across the throat section allows for greater mass throughput of air for a given fan horsepower. More efficient use of the kinetic energy of the primary air flow results in increased maximum mass throughput of coal. This increases the mill capacity (or alternatively enables reduction of air flow).

Further, reduced air turbulence in the mill results in reduced wear on the throat/ring assembly, the mill body, and every other interior mill part. Because of reduced air turbulence in the mill, there is more efficient classification of the crushed particles resulting from less turbulent air entering the classifier section. It also reduces coal spillage. The resulting increase in grinding efficiency enables reduced power consumption in the mill.

The apparatus of the invention can be fabricated and installed more economically than previous designs. This is the only apparatus which can be composed of lightweight components and still provide acceptable service life.

Other advantages of the apparatus of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
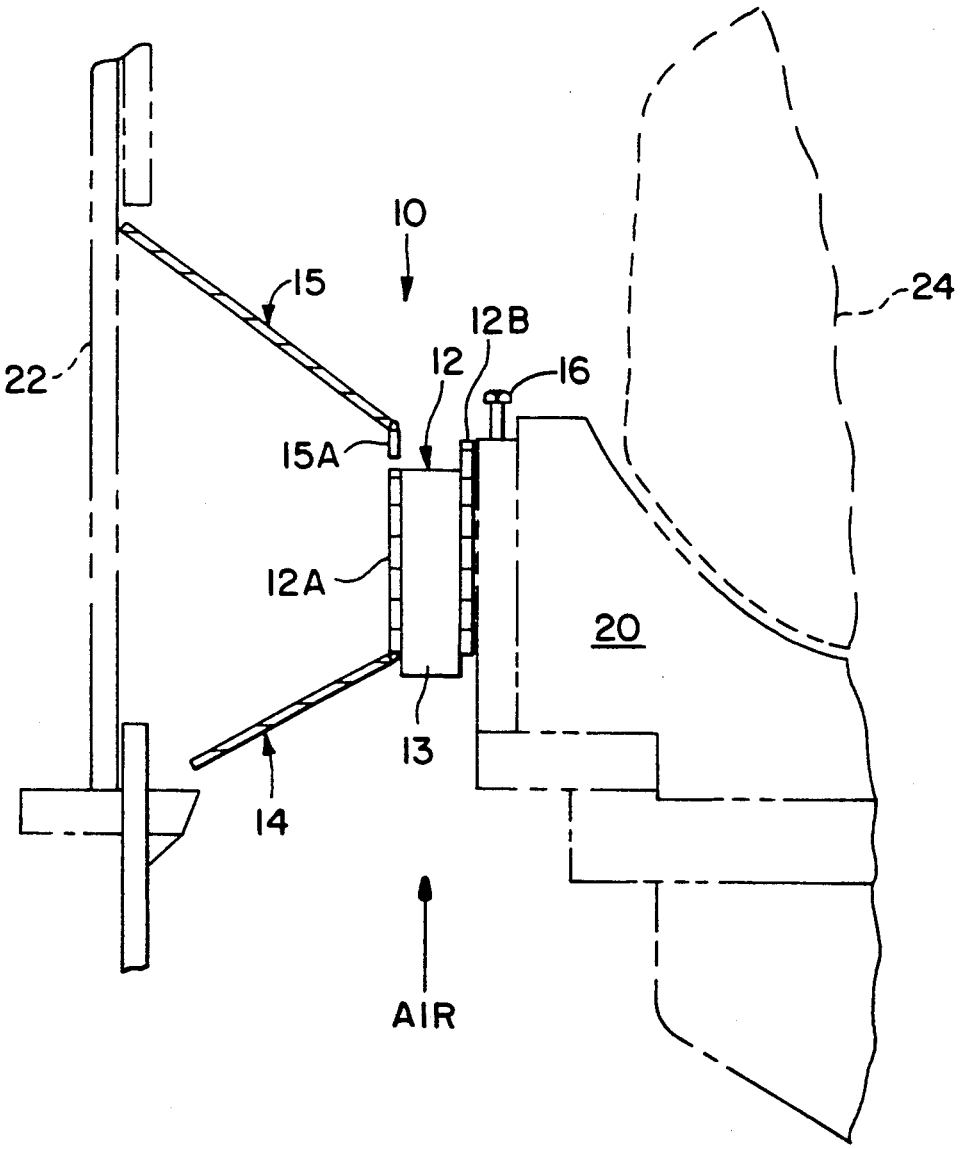
FIG. 1 is a cross-sectional view illustrating one embodiment of vaned throat/air port ring assembly of the invention.

In FIG. 1 there is shown one embodiment of rotating throat/air port ring assembly 10 of this invention installed in a pulverizing mill including a rotating bowl 20 within a housing 22. A grinding member 24 is positioned and retained in the mill in such a manner that it crushes solid material present in the bowl as the bowl is rotated.

There is an annular passage between the interior surface of the housing and the periphery of the bowl. This enables air to flow upwardly around the peripheral edge of the bowl through a vaned throat/air port ring element 12 secured to the periphery of the bowl.

The ring element comprises a plurality of spaced-apart vaned members 13. Normally the vane members 13 are secured between spaced-apart ring support members 12A and 12B which are inner and outer peripheral walls. Support member 12B may be secured to the periphery of the bowl by means of bolts 16 or by welding, for example. Vane members 13 are normally welded at each of their side edges to opposing support members 12A and 12B.

An inlet skirt 14 is disposed below the ring element 12 and extends downwardly and outwardly therefrom. The inlet skirt extends annularly around the ring element. The purpose of the inlet skirt 14 is to direct upwardly moving air smoothly into the throat or passage between the bowl and the interior surface of the housing and this is essential to the proper functioning of the device. Without this skirt there would be excessive turbulence of the inlet air.

Normally the upper edge of the inlet skirt is secured to the lower edge of ring element 12, as illustrated. The gap between the outer edge of the inlet skirt and the interior surface of the housing is less than about one inch. Alternatively, the lower edge of the inlet skirt could be secured to the interior surface of the housing, with only a small gap (less than about one inch) existing between the upper edge of the skirt and the lower edge of the ring element. The inlet skirt can be planar in cross-section or it may be curved, if desired.

The inlet skirt is constructed of lightweight material (e.g., 0.5 inch steel) in order to ensure reliable service of the throat/air port ring. By minimizing the weight of the throat sections, it is easier to keep them attached to the rotating bowl during use.

An inclined liner member 15 extends upwardly and outwardly from the upper edge of the ring element to the interior surface of the housing. Normally the liner member is secured to the interior surface of the housing and extends to a point directly above the outer edge of the ring member 12, as shown. Then the liner member extends vertically downwardly to within about 0.5 inch of the upper edge of the ring member. This drop is critical and unique. The minimum drop is 2 inches. and the maximum drop is about 4 inches. The preferred drop is 3 inches.

The vertical wall section 15A is integral with the inner edge of liner 15, as shown. It is aligned vertical over the outer peripheral wall 12A of the ring element.

The purpose of the liner member 15 is to direct particles back to the path of the air flow and to prevent build up of crushed particles around the periphery of the housing during processing. The minimum angle of inclination of the liner is 30°, and the maximum angle of inclination is about 45°.

Preferably the inner and outer peripheral walls of the ring element are vertical and are parallel to each other. The flow of air through the ring element is in the vertical direction and this is unique. Prior conventional designs use a converging-diverging liner assembly in order to promote a primary classification effect of the coal particles by abruptly redirecting air flow inward toward the center of the bowl.

The width of the vane members is in the range of 2 to 7.5 inches. The height or depth of the vane members is in the range of 6 to 7 inches.

Particles produced by the crushing or pulverizing process are carried upwardly by means of air passing through the ring element. With the apparatus of this invention the air flows upwardly in a nearly vertical manner with minimal swirling or spinning. As a result, the crushed particles are lifted upwardly in a smooth and efficient manner.

The vertical drop from the liner member 15 to the upper surface of the ring element is necessary and extremely important to the proper functioning of the apparatus. Wall section 15A and wall 12B above the top edge of the ring element form a smooth outlet for the air exiting the throat section of the apparatus. This feature allows the downwardly falling coal particles to be turned upward by the primary air flow through the throat. This eliminates any flow separation and/or turbulence which may occur at the top of the vaned throat outlet resulting in a reduction of unwanted coal spillage and the elimination of wear in the throat/air port. Without the vertical wall sections 15A and 12B above the ring element, the air flow stream would flair out and dissipate the kinetic energy available for upward coal transport too rapidly. That would result in heavy coal spillage, excessive wear and unpredictable fineness control.

Figure 3:
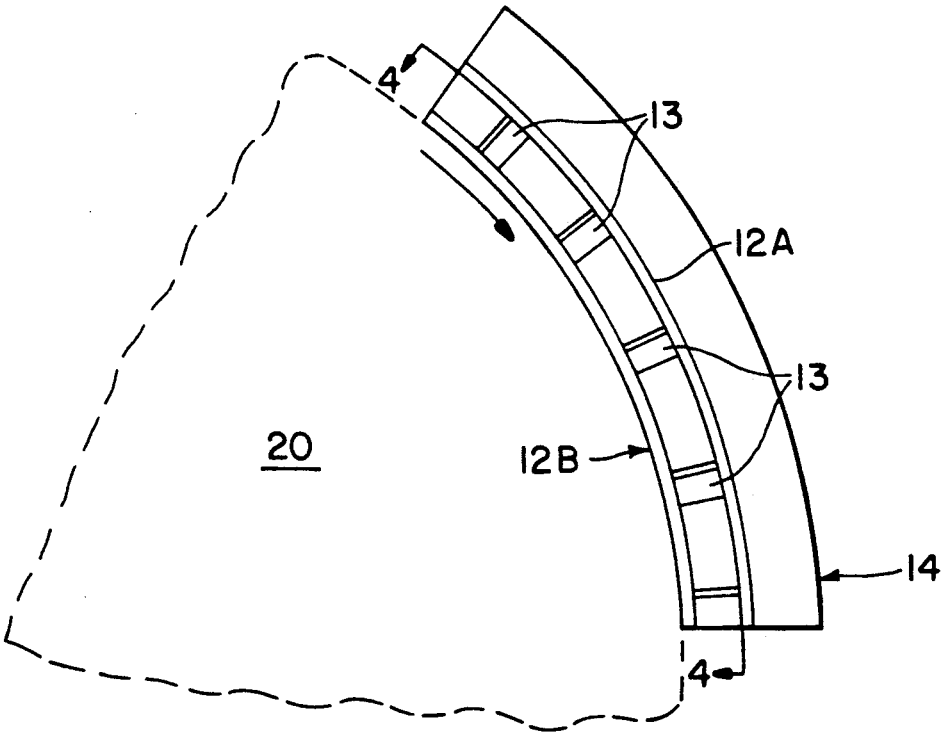
FIG. 3 is a top view of a segment of the vaned throat ring element and skirt member of the embodiment shown in FIG. 1.
Figure 4:
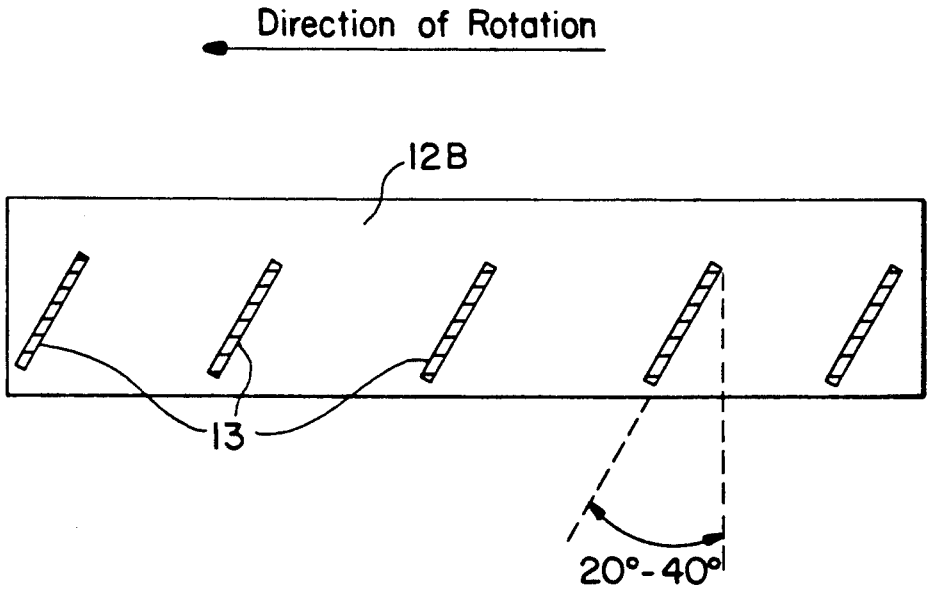
FIG. 4 is a cross-sectional view taken along line 4—4 in FIG. 3.

FIG. 3 is a top view of the ring element and the inlet skirt 14. FIG. 4 is a cross-sectional view taken along line 4—4 in FIG. 3. These figures illustrate the spaced-apart vanes 13.

The angle of inclination of the vanes is in the range of 20° to 40° from vertical. Preferably the angle of inclination is 25°–30°. The upper ends of the vanes are tilted in a direction opposite to the direction of normal rotation of the bowl. These angles of inclination or tilt are critical to the proper functioning of the apparatus and depend upon the bowl diameter and rotational speed. When the angle of inclination is less than about 20°, there is unnecessary wear above the liner and there is a lack of fineness control. When the angle of inclination is greater than 40°, greater throat velocity is required and there is an increased wear pattern. Also, when the angle is greater than 40°, it is necessary to use wear-resistant material in the throat and liner assembly.

The spacing between adjacent vanes 13 is between 5 to 7 inches. Preferably the spacing between adjacent vanes is uniform around the ring member.

FIG. 3 illustrates another feature of the apparatus of the invention. Thus, as illustrated, the ring element may be composed of separate arced segments which are individually secured to the periphery of the bowl.

Figure 2:
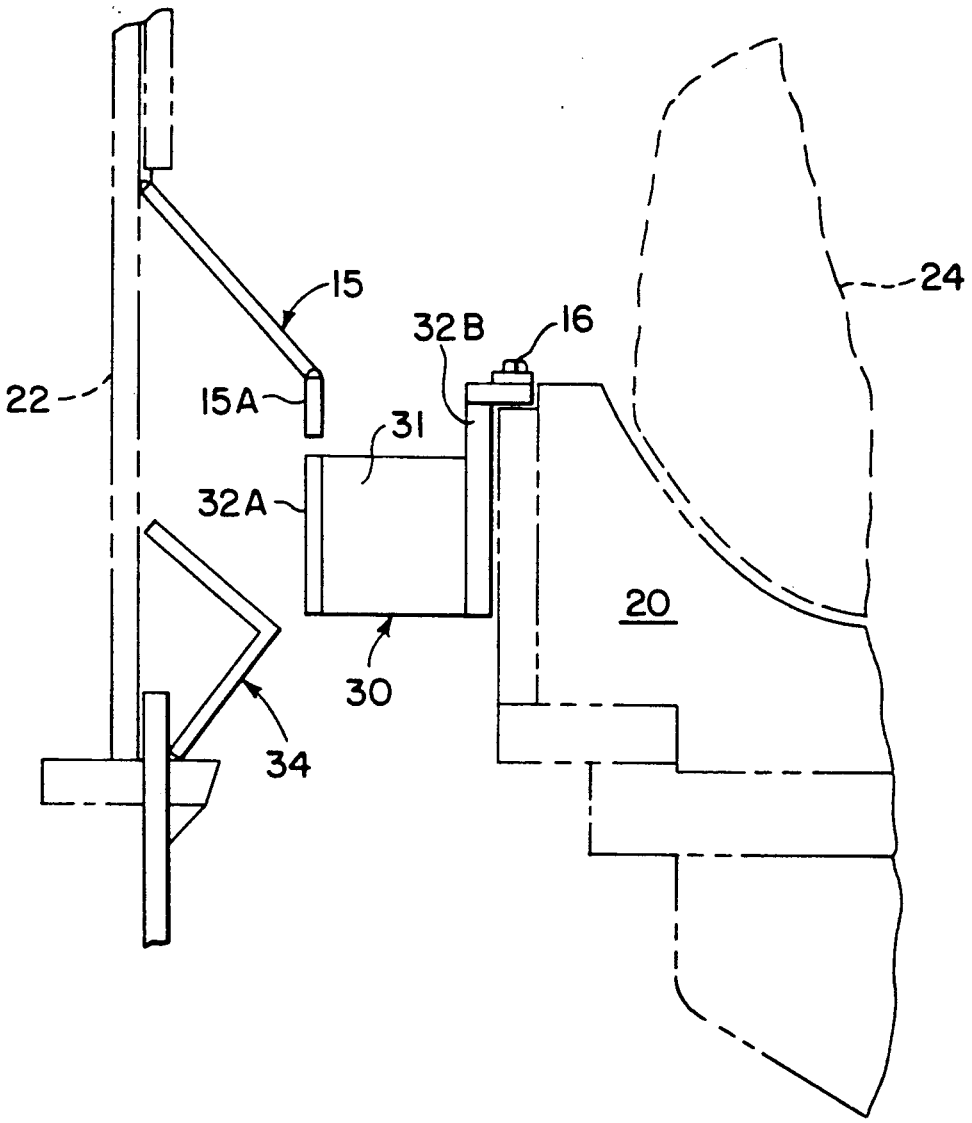
FIG. 2 is a cross-sectional view illustrating another embodiment of vaned throat/air port ring assembly.

FIG. 2 illustrates another embodiment of the apparatus of this invention. In this embodiment the inlet skirt 34 is secured to the interior surface of the housing 22 and it extends upwardly to the lower edge of the ring element 30 which comprises vanes 31 secured between supports 32A and 32B.

The apparatus of this invention reduces the total weight of the ring element, allowing for a more reliable long-term operation of the pulverizing mill. The inlet skirt 34 is a self-cleaning, stationary device which will still beneficially affect the upwardly moving air flow while not actually being in contact with the rotating ring element.

What is claimed is:

1. In a pulverizer mill of the type including a housing, a rotating bowl member rotatably supported in said housing, a grinding member for crushing solid materials present in said bowl, and an annular passage between the interior surface of said housing and the periphery of said bowl member which enables air to flow upwardly through said passage, wherein the improvement comprises:

(a) a vaned throat/air port ring element secured to the periphery of said bowl member and extending into said annular passage, said ring element including an outer periphery and a plurality of spaced-apart vane members having upper and lower ends; wherein said vane members are oriented at an angle in the range of about 20° to 40° relative to a vertical axis in a manner such that said upper ends are tilted away from the direction of rotation of said bowl member;

(b) an inclined liner member extending around said bowl member above said ring element, wherein said liner member includes inner and outer edges, wherein said outer edge is adjacent to said interior surface of said housing and said inner edge is above said outer periphery of said ring element and further includes a vertical wall section extending downwardly to a point adjacent said ring element;

(c) a skirt member carried by said ring element; wherein said skirt member extends outwardly and downwardly from said ring element to a point adjacent said interior surface of said housing; wherein the angle of said skirt member relative to a vertical axis is in the range of 40° to 60°.

2. The improvement in accordance with claim 1, wherein said vane members are spaced apart from each other by a distance in the range of about 5 to 7 inches.

3. The improvement in accordance with claim 1, wherein said outer edge of said liner member is secured to said interior surface of said housing, and wherein said vertical wall section has a height of at least about 2 inches.

4. The improvement in accordance with claim 1, wherein said skirt member is secured to and supported by said ring member.

5. The improvement in accordance with claim 1, wherein said ring element comprises a plurality of arc-shaped segments which are each secured to the periphery of said bowl member.

6. In a pulverizer mill of the type including a housing, a rotating bowl member rotatably supported in said housing, a grinding member for crushing solid materials present in said bowl, and an annular passage between the interior surface of said housing and the periphery of said bowl member which enables air to flow upwardly through said passage, wherein the improvement comprises:

(a) a vaned throat/air port ring element secured to the periphery of said bowl member and extending into said annular passage, said ring element including inner and outer peripheral walls and a plurality of spaced-apart vane members having upper and lower ends; wherein said vane members are oriented at an angle in the range of 20° to 40° relative to a vertical axis in a manner such that said upper ends are tilted away from the direction of rotation of said bowl members, wherein said vane members are positioned between said peripheral walls and are spaced apart from each other by a distance in the range of about 5 to 7 inches;

(b) an inclined liner member extending around said bowl member above said ring element, wherein said liner member includes inner and outer edges, wherein said outer edge is adjacent said interior surface of said housing and said inner edge is above said outer peripheral wall of said ring element and further includes a vertical wall section extending downwardly to a point adjacent said ring element;

(c) a skirt member carried by said ring element; wherein said skirt member extends outwardly and downwardly from said ring element to a point adjacent said interior surface of said housing; wherein the angle of said skirt member relative to a vertical axis is in the range of about 40° to 60°.

7. The improvement in accordance with claim 6, wherein said outer edge of said liner member is secured to said interior surface of said housing, and wherein said vertical wall section has a height of at least about 2 inches.

8. The improvement in accordance with claim 7, wherein said skirt member is secured to and supported by said ring member.

9. The improvement in accordance with claim 6, wherein said ring element comprises a plurality of arc-shaped segments which are each secured to the periphery of said bowl member.

10. The improvement in accordance with claim 6, wherein the spacing between adjacent vane members is uniform around said ring member.

11. The improvement in accordance with claim 6, wherein said vane members have a height in the range of 6 to 7 inches.

12. The improvement in accordance with claim 6, wherein said liner member is inclined at an angle in the range of 30° to 45°.

13. The improvement in accordance with claim 6, wherein said skirt member is inclined at an angle of 40° to 60°.

14. The improvement in accordance with claim 6, wherein the width of said vane members is in the range of 2 to 7.5 inches.

* * * * *